United States Patent [19]

Wiley

[11] Patent Number: 4,583,799

[45] Date of Patent: Apr. 22, 1986

[54] MULTIPLE OUTLET RECEPTACLE

[75] Inventor: Roy O. Wiley, Huntington, Conn.

[73] Assignee: Westinghouse Electric Corp., Pittsburgh, Pa.

[21] Appl. No.: 542,627

[22] Filed: Oct. 17, 1983

[51] Int. Cl.[4] ..... H01R 4/66

[52] U.S. Cl. ..... 339/14 R; 339/154 A; 339/159 C; 339/164 M

[58] Field of Search ..... 339/14 R, 157, 159, 339/154 R, 154 A, 14 R, 14 P, 147 R, 147 P, 164, 166, 168, 170

[56] References Cited

U.S. PATENT DOCUMENTS

| | | | |
|---|---|---|---|
| 1,318,733 | 12/1924 | Eckstein | 339/14 R |
| 1,717,836 | 6/1929 | Conner | 339/159 |
| 2,228,334 | 1/1941 | Abbott | 339/157 R |
| 3,017,601 | 1/1962 | Benander | 339/157 R |
| 3,034,084 | 5/1962 | Schmier | 339/14 R |
| 3,054,954 | 9/1962 | Haram | 339/147 P |
| 3,327,277 | 6/1967 | Ramsing | 339/14 R |
| 3,697,924 | 10/1972 | Oliver | 339/14 R |
| 3,701,074 | 10/1972 | Oster | 339/14 R |
| 3,909,912 | 10/1972 | Kiesling | 29/428 |
| 3,997,225 | 12/1976 | Horwinski | 339/14 R |
| 4,240,686 | 12/1980 | Kurbikoff | 339/14 R |

*Primary Examiner*—Gil Weidenfeld
*Assistant Examiner*—David L. Pirlot
*Attorney, Agent, or Firm*—G. H. Telfer

[57] ABSTRACT

A multiple outlet receptacle, such as with four outlets, is provided that has a housing that accommodates the internal contact elements which are respectively supported on conductive plates within the housing that include two plates fitting within the same plane and having the contact elements extending forwardly therefrom to plug receiving apertures in the front face of the housing. The internal contact elements and the front face apertures are configured so that angle plugs may be placed in each of the four outlets without interference with each other or their line cords and may extend in each of four orthogonal directions to fixtures with which they are connected. The housing can be of molded insulating material integrally formed with a mounting flange.

4 Claims, 7 Drawing Figures

MULTIPLE OUTLET RECEPTACLE

BACKGROUND AND SUMMARY OF THE INVENTION

This invention relates to electrical wiring devices and particularly to unitary receptacles having multiple, especially four, outlets.

Receptacles with two outlets are commonly used for receiving the plugs of two appliances. In certain instances it is desirable to provide a receptacle with more than two outlets to reduce the installation time. The present invention is particularly directed to a receptacle having four outlets such as for office lighting applications where it would be normally installed in a ceiling recess fixture, such as an outlet box or concrete ring, and permits four fixtures to be plugged in at one receptacle location. The receptacle is designed in one embodiment to have a shallow body of molded insulating material with an integral mounting flange at the rear edges of the body so the receptacle does no extend into the recess fixture, thus requiring less recess volume. In other forms of the invention, the mounting flange may be located forwardly of the rear edges of the shallow body so the body extends within the recess fixture. Internal contact elements of the four outlets are located within the housing portion of the body and the front face has plug blade receiving apertures for communicating with the internal contact elements. A rear closing plate of insulating material is configured to fit within the back edge of the housing portion substantially flush with the mounting flange and provides a substantially planar rear surface for the entire unit.

The internal contacts extend forwardly from first and second conductive plates that rest within the housing. A first conductive plate is configured as a ring and is located near the periphery of the unit while the second conductive plate is configured to fit within the aperture of the first plate and can be made from the same piece of starting material as the first plate. Each plate supports a contact element for each of the four receptacles that is aligned with a plug aperture in the front face. For a grounding receptacle, as is frequently desired, a third group of the internal contact elements is included that is attached to a third conductive plate that is located on the outside, rearward, surface of the closing plate and extends through apertures within the closing plate.

An additional feature of the invention is that the ring-shaped conductive plate is provided with means for readily separating it into two separate plate portions, such as by a break-off element that can be easily severed by an installer so each plate portion has contact elements for two outlets only. The purpose in doing so is for connection to a multiwire circuit or to permit the switching of two outlets while the other two outlets are always energized. The break-off portion is accessible through an opening in the rear closing plate so disassembly is not required in order to use it.

The unit achieves compactness as well as economy in the use of material. One example of this is that the smaller line terminal plate is blanked from the scrap inside of the larger of the two conductive plates and the two plates are disposed in the unit in a common plane that contributes to the shallowness of the design.

Another aspect of the invention is that the four outlets are oriented, by the configuration of the internal contacts and the plug receiving apertures, so that four angle plugs having line cords coming out parallel to the front face of the receptacle can be used without interfering with each other. This is done by having the pattern such that each plug and cord extends away from the receptacle in one of four orthogonal directions and none of the cords needs to pass over any of the other cords or plugs. In contrast, with a normal duplex receptacle, the outlet configuration is such that each plug pattern requires the use of a plug that causes the line cord to extend away from the receptacle in the same direction and angle plugs cannot be used. With the invention, better appearance is achieved by having no drooping cords and also by having cords extend in different directions toward fixtures arranged in different directions from a centrally located receptacle.

While particularly shown and described in the form of a four outlet receptacle, it will be apparent that aspects of the invention such as the conductive plate configuration on which the internal contacts are supported may be advantageously utilized in receptacles having other numbers of outlets.

DESCRIPTION OF THE PREFERRED EMBODIMENT

Figure 1:
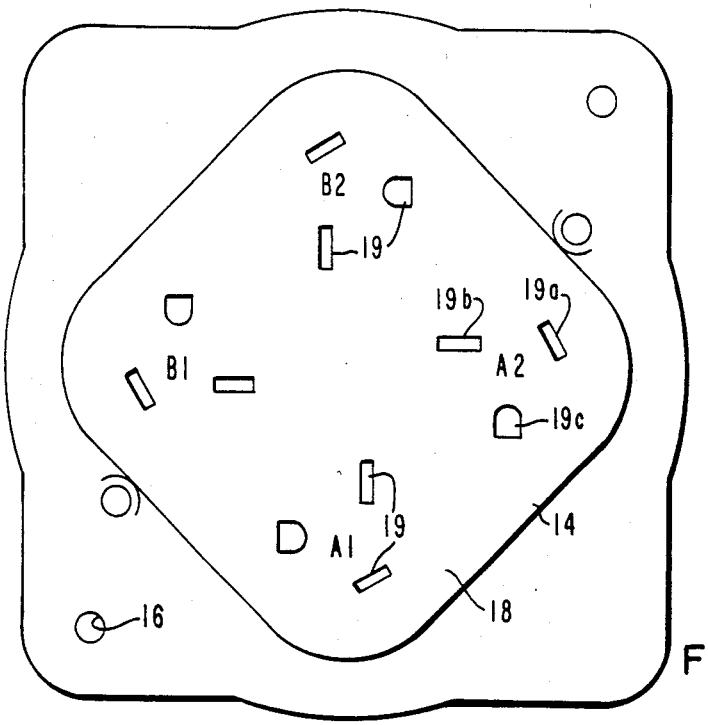
FIG. 1 is a front face view of a receptacle in accordance with an embodiment of the present invention.

Referring to the drawings, a four outlet receptacle is shown comprising a molded insulating body 10 including a mounting flange 12 and a housing portion 14 that are integrally formed. The mounting flange 12 extends laterally away from the housing portion 14 and has fastener receiving apertures 16 therein for mounting the receptacle to an outlet box.

The housing portion has a front face 18 and a back edge 20 with the back edge joined with the flange 12 and the front face located forward of the flange so that when mounted in an outlet box the housing portion 14 extends forwardly rather than back from the flange within the box. In other embodiments, the housing portion may extend back from the flange, including the case in which part of the housing portion extends forwardly and part backwardly from the flange. The embodiment shown is preferred where minimal volume may be available in the fixture in which the receptacle is installed.

The front face 18 has plug blade receiving apertures 19 for accommodating the blades of four plugs in four outlets A1, A2, B1, and B2.

Figure 4:
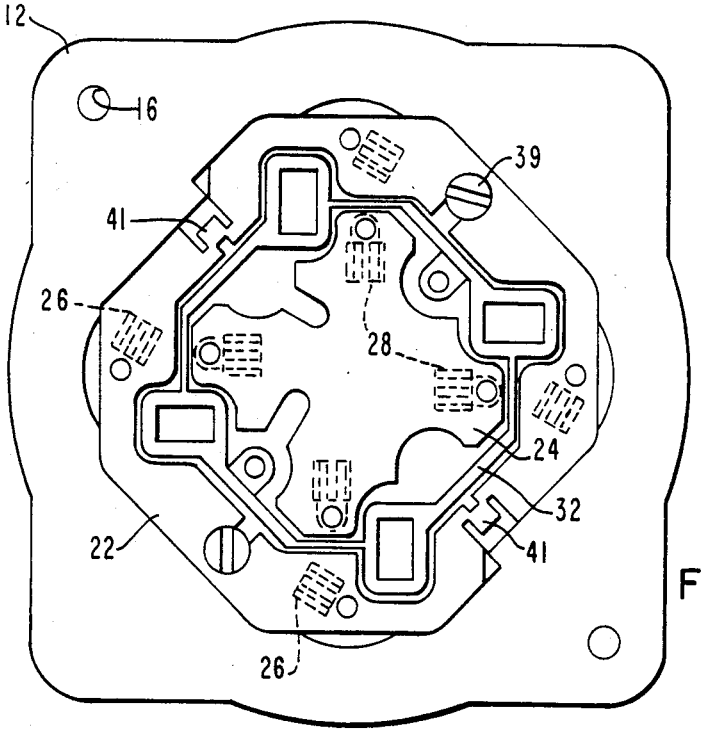
FIG. 4 is a rear view of the receptacle of FIG. 3 with the back closing plate removed.
Figure 5:
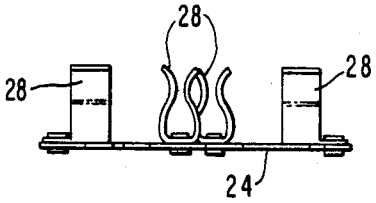
FIGS. 5 and 6 are respectively side elevation views of the inner and outer terminal assemblies of the receptacle.
Figure 6:
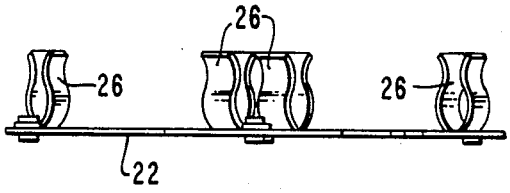

Internal contact elements of four outlets are located within the housing portion 14. As seen in FIGS. 4, 5 and 6, the terminal assemblies for the internal contacts include first and second conductive plates 22 and 24 to which forward extending contact elements 25 and 28, respectively, for receiving the plug blades for each outlet are attached. The first conductive plate 22 is configured as an apertured ring and the second conductive plate 24 is configured to fit within the aperture of the first conductive plate in the same plane. The two plates 22 and 24 can be stamped from the same piece of starting material. The plates 22 and 24 rest on insulating supports 30 within the housing portion 14 with the internal contact elements 26 and 28 extending forwardly therefrom in spaces between the insulating supports. An insulating barrier 32 extends between the plates 24 and 26. All of the insulating supports 30 and the insulating barrier 32 are formed as integral parts of the body 10.

A third group of internal contact elements 34 is provided for grounding. The assembly of the third group of contact elements 34 includes a third conductive plate 36 that is located on the outside, rearward, surface of a closing plate 38. Closing plate 38 is an insulating plate, formed separately from the body 10, and fastened to the housing portion 14, such as by fasteners 40 that extend through both the conductive plate 36 and closing plate 38 into the housing portion. The third group of internal contacts 34 extends from plate 36 through apertures within the closing plate 38 into the housing portion and also communicates with apertures 19 in the front face 18.

Screw terminals 39, or other terminal means, for wire connections to the internal contact elements are provided that are accessible on the rear surface of closing plate 38.

Figure 3:
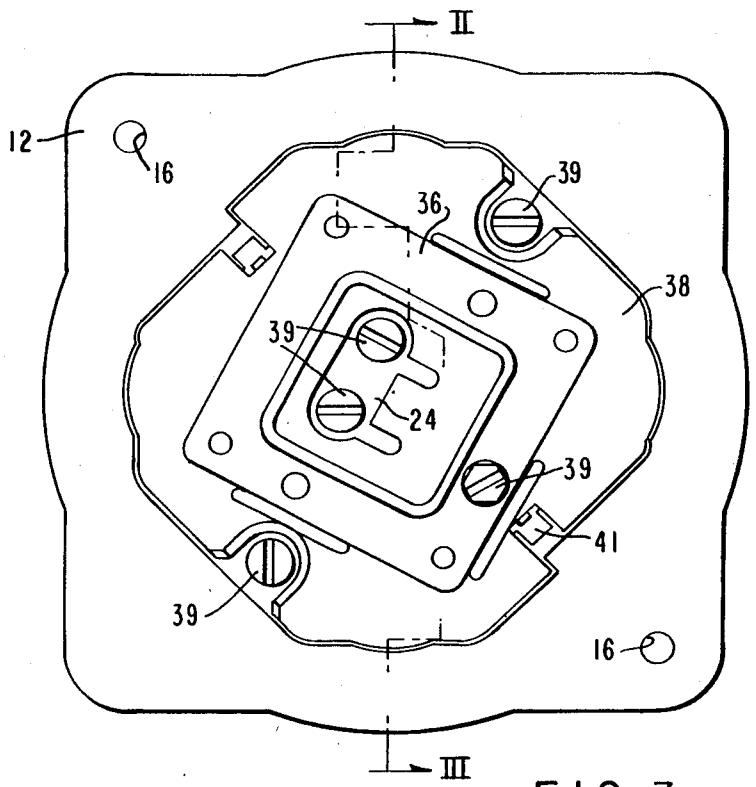
FIG. 3 is a rear view of the receptacle of FIG. 1.
Figure 2:
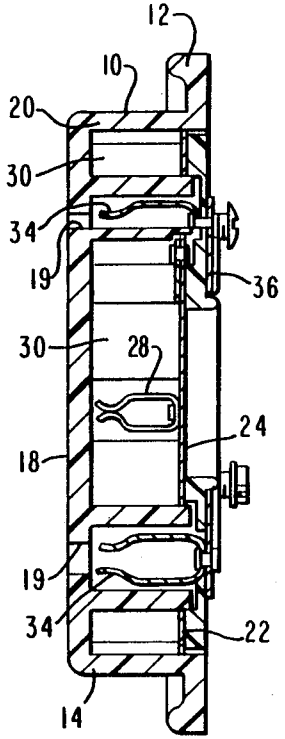
FIG. 2 is a sectional view taken along the line II—II of FIG. 3.

As seen in FIGS. 3 and 4 the first conductive plate 22 is provided with a break-off portion 41 which can be easily separated by clipping into two separate plate portions each with two internal contact elements 26 supported thereon for permitting two of the outlets (e.g. A1 and A2) to be separately controlled from the other two outlets (B1 and B2). If desired, means could be provided for separating the plate 22 into four distinct elements so that each outlet can be separately controlled if desired such as by an individual switch for each of four lighting fixtures.

Figure 7:
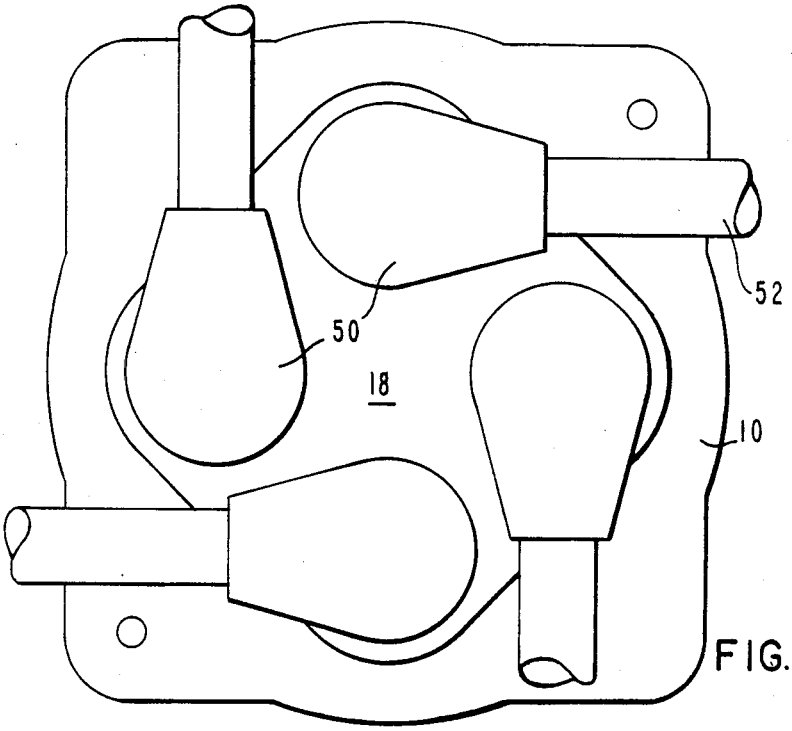
FIG. 7 is a front view of the receptacle with plugs in place.

The view of FIG. 1 shows the pattern of plug blade apertures 19 that requires insertion of a distinctly configured three-pronged grounding plug in a specific orientation. That is, in this example, each includes a slanted aperture **19*a* for receiving a blade contacting the hot line terminal 26 of each outlet and a straight aperture 19*b* for receiving a blade for contacting the inner terminal 28 or neutral terminal of the unit outlets while there is a substantially half circular type of opening 19*c* for receiving the grounding prong of a plug. All the "slant" openings 19*a* of the four outlets are outwardly disposed on the front face 18 from the "straight" opening 19*b* of the respective outlets. This is consistent with the contact arrangement in which contacts 26 are attached to the ringlike plate 22 and contacts 28 are attached to the centrally disposed plate 24. Besides facilitating the construction of the unit and contributing to its shallowness, this arrangement is desirable to permit the use of angle plugs 50 such as are shown in FIG. 7. An angle plug is one that has the line cord extending laterally in a direction at an angle (normally perpendicular) to the plug blades, in contrast to those with the blades and line cord parallel to each other. Here cords 52 all extend parallel to the face 18** of the receptacle and provide a space saving and a neater appearance than if straight plugs and cords perpendicular to the face of the receptacle were used. The unique pattern of the contact and front face configuration permits a compact arrangement for the plug blades to fit within, without interference, as well as directing the cords in four different orthogonal directions so that they can directly extend to fixtures arranged around the receptacle.

There has been shown and described a multiple outlet receptacle, particularly for four outlets, that achieves the purposes of compactness and economy in the use of material while providing simple installation and attractive appearance as installed and used. It will be apparent that certain modifications can be made from the specific form of the device as shown consistent with the teachings hereof.

I claim:

1. A multiple outlet receptacle comprising:

a molded insulating body including a mounting flange and a housing portion integrally united;

said mounting flange laterally extending away from said housing portion and having fastener accommodating means therein for mounting the receptacle;

said housing portion having a front face and a back edge, said back edge being joined with said flange, with said front face located forward of said flange;

internal contact elements of a plurality of outlets located within said housing portion, said front face of said housing portion having plug blade receiving apertures for communicating with said internal contact elements;

a first group of said internal contact elements being attached to a first conductive plate configured as an apertured ring and a second group of said internal contact elements being attached to a second conductive plate that is disposed within said aperture of said first conductive plate in a common plane each of said first and second conductive plates resting on insulating supports within said housing portion with said internal contact elements extending frontwardly therefrom in spaces between said insulating supports and an insulating barrier extends between said first and second conductive plates, said insulating supports and said insulating barrier being integral with said housing portion;

a rear closing plate of insulating material configured to fit within said back edge of said housing portion substantially flush with said flange;

a third group of said internal contact elements being attached to a third conductive plate that is located on the outside, rearward, surface of said closing plate and said third group of said internal contact elements extending through apertures within said closing plate;

terminal means for wire connections to said internal contact elements and accessible on the rear surface of said closing plate; and, said internal contact elements and said plug blade receiving apertures for communicating therewith being arranged in a pattern so each outlet can receive a plug of like configuration and a cord attached to each such plug can extend laterally away from said housing portion substantially parallel to said front face without interference among the plugs and their cords.

2. A multiple outlet receptacle in accordance with claim 1 wherein:

said first conductive plate is provided with means for readily separating it into separate plate portions for permitting a number of said outlets to be separately controlled from others of said outlets.

3. A multiple outlet receptacle in accordance with claim 1 further comprising:

a plurality of plugs having blades respectively disposed in conductive engagement with said internal contact elements of said plurality of outlets, said plugs being angle plugs each having a line cord extending parallel to said front face of said housing portion in different directions without interference.

4. A multiple outlet receptacle in accordance with claim 3 wherein:

said plurality of plugs and said plurality of outlets each number four and said line cords of said plugs extend in four different orthogonal directions.

* * * * *